United States Patent [19]

Sauer et al.

[11] 4,393,763

[45] Jul. 19, 1983

[54] METHOD AND APPARATUS FOR PRE-DRAPING AN OBJECT RECEIVING STATION WITH FLEXIBLE BINDING

[75] Inventors: L. Peter Sauer, Glenview; Ronald W. Gurak, Fox River Grove, both of Ill.

[73] Assignee: Signode Corporation, Glenview, Ill.

[21] Appl. No.: 261,969

[22] Filed: May 8, 1981

[51] Int. Cl.[3] ..... B65B 13/10

[52] U.S. Cl. ..... 100/2; 100/3; 100/28; 100/33 PB; 156/502

[58] Field of Search ..... 100/2, 33 PB, 27, 28, 100/29, 4, 3; 156/494, 73–75, 502

[56] References Cited

U.S. PATENT DOCUMENTS

| | | | |
|---|---|---|---|
| 1,875,260 | 8/1932 | Parker | 100/28 |
| 2,608,150 | 8/1952 | Cranston | 100/27 |
| 2,705,914 | 4/1955 | Cranston | 100/28 |
| 2,920,553 | 1/1960 | Van Marle | 100/27 |
| 3,324,789 | 6/1967 | Buettner | 100/27 |
| 3,548,740 | 12/1970 | Kobiella | 100/28 |
| 3,665,845 | 5/1972 | Lyon | 100/27 |
| 3,771,345 | 11/1973 | Vascotto et al. | 100/4 |
| 4,153,499 | 5/1979 | Annis | 100/28 X |

*Primary Examiner*—Billy J. Wilhite

*Attorney, Agent, or Firm*—Dressler, Goldsmith, Shore, Sutker & Milnamow, Ltd.

[57] ABSTRACT

An apparatus and method are disclosed for forming a loop of flexible binding about objects positioned seriatim in an object receiving station. The apparatus includes a chain loop driven around the object receiving station. While a previously bound first object is in the receiving station, the chain is driven in one direction to move carrier rollers on the chain so as to pull the trailing portion of a binding through a major portion of the locus of a closed path around the receiving station while the lead end of the binding is held adjacent the receiving station. Spaced portions of the binding are guided from the interior of the path around the receiving station to maintain the binding in the configuration spaced outwardly of the receiving station. Subsequently, the first bound object is removed from the receiving station and a second object is positioned therein. The guiding of the interior of the binding around the receiving station is terminated so as to permit the binding to contact the second object while further pulling the trailing portion of the binding to complete the closed path and then form a tensioned loop about the second object.

12 Claims, 15 Drawing Figures

METHOD AND APPARATUS FOR PRE-DRAPING AN OBJECT RECEIVING STATION WITH FLEXIBLE BINDING

DESCRIPTION

1. Technical Field

This invention relates to methods for automatically binding an article with an apparatus of the chuteless type wherein a length of binding, such as plastic strapping, is drawn from a source and is caused to encircle an article so as to establish a closed, tensioned loop having overlapping end portions which subsequently become united to each other by suitable means, such as by a friction-fusion seal.

2. Background of the Invention

A variety of chuteless machines have been proposed and used for automatically binding an article wherein the binding, such as a strap, unwinds from a source, such as a strap reel, while the leading end of the strap is gripped adjacent the package and the trailing portion is moved around the article.

Typically, the article or package is inserted and supported at a package receiving station encircled by a ring. The ring, or a carrier mounted on the ring, is then driven through a full revolution about the package to wrap the strap into a tight loop configuration having opposite strap ends superposed for sealing. Examples of such machines are illustrated in the U.S. Pat. Nos. 2,705,914, 2,608,150, 4,153,499, 3,324,789, and 1,875,260.

In another type of machine for binding packages, the ring around the article receiving station is replaced with a chain drive system supported in a suitable framework to define a generally rectangularly shaped window around the package receiving station. Fixed to the chain is a strap carrier, such as a pair of spaced-apart rollers, which engage the trailing portion of a strap in a slip-feed manner and which are moved by the chain around the package to move the trailing portion of the strap in a tight loop around the package. An example of such a machine is disclosed in the U.S. Pat. No. 3,548,740.

Until the time of the present invention, it has been difficult to achieve high speed operation of such binding machines with respect to binding objects positioned seriatim in the receiving station. Typically, after a first object is bound, it must be removed from the receiving station and then a second object moved into position in the receiving station before the binding can be pulled around the receiving station. Following proper positioning of the second object in the receiving station, the typical machine is cycled to (1) encircle the second object with the binding, (2) apply tension to the binding loop, (3) seal the loop, and (4) then sever the loop from the rest of the strap.

In many applications, it would be desirable to provide a method and apparatus for effecting the binding of the objects, one after the other, in a rapid sequence. Preferably, the machine operation would eliminate, or substantially reduce, the time interval during which the machine initially encircles the object with the binding after the object has been moved into position in the receiving station.

SUMMARY OF THE INVENTION

An apparatus is provided for forming a loop of flexible binding about objects positioned seriatim in an object receiving station. The apparatus includes means for restraining an end of the binding adjacent the receiving station and then pulling the trailing portion of the binding in a closed path around the object. The apparatus includes means for initially pulling the trailing portion of the binding through a major portion of the locus of a closed path around the receiving station. The apparatus has guides spaced inwardly of the closed path for guiding spaced portions of the binding from the interior of the closed path to retain the binding in a configuration spaced outwardly of the receiving station.

According to a preferred method of operation, after a first object is bound in the receiving station in the apparatus, and before a second object is positioned in the receiving station, the apparatus is operated to initially "pre-drape" or pull the trailing portion of the binding through the major portion of the locus of the closed path around the receiving station where it is held outwardly of the receiving station by the guides.

After commencing this "pre-draping" of the receiving station with a portion of binding, the bound first object, is removed from the receiving station and a second object is moved into proper position in the receiving station. Thus, by the time the second object has been properly positioned in the receiving station, the "pre-draping" of the receiving station with the binding has been completed so that the binding need only be pulled a relatively small additional distance around the second object and then tightened about the second object. To this end, the guides are actuated to release the outwardly spaced length of binding and, at the same time, the binding is further pulled to complete the closed path about the second object and to then form a tensioned loop about the second object.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
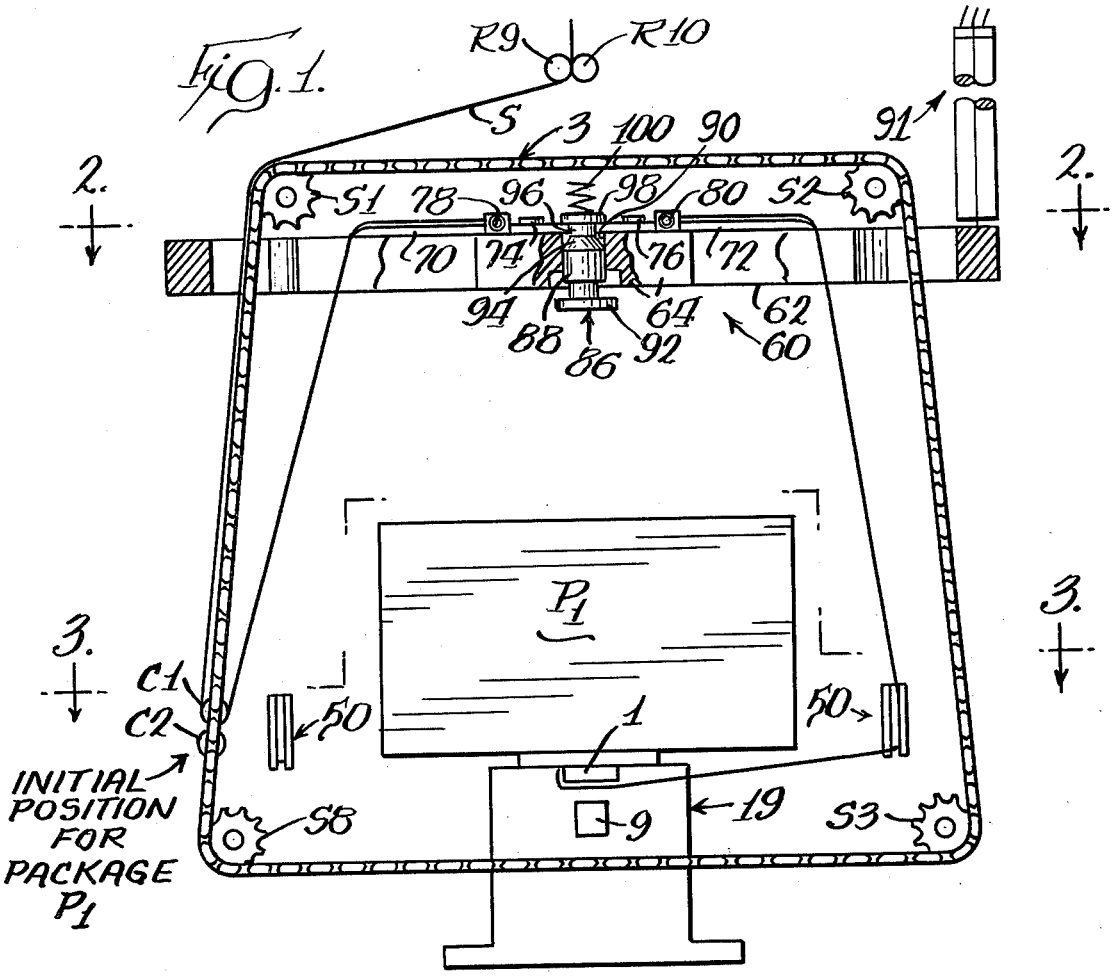
FIG. 1 is a fragmentary diagrammatic view of a strapping apparatus utilizing a chain-driven carrier for draping a loop of strap about a package $P_1$ and showing the carrier and strap at an initial position at the start of cycle.

While this invention is susceptible of embodiment in many different forms, there are shown in the drawings and will herein be described in detail a preferred embodiment of the invention. It will be understood, however, that the present disclosure is to be considered as an exemplification of the principles of the invention and is not intended to limit the invention to the embodiment illustrated.

The precise shapes and sizes of the components herein illustrated are not essential to the apparatus unless otherwise indicated.

It will be understood that the apparatus disclosed herein has certain conventional mechanisms, including drive mechanisms, control mechanisms, strap sealing mechanisms, and the like, the details of which, though not fully illustrated or described, will be apparent to those having skill in the art and an understanding of the necessary functions of such mechanisms.

For ease of description, the apparatus disclosed herein will be described in the normal operating position and terms such as upper, lower, horizontal, etc., will be used with reference to the normal operating position. It will be understood, however, that the apparatus may be manufactured, stored, transported, and sold in an orientation other than that normal operating position described.

Referring now to the drawings, the general arrangement and sequence of operation of a novel package binding apparatus can be best understood with reference to FIGS. 1–8. The novel apparatus disclosed in the instant application is illustrated as a modification of an existing strapping machine manufactured and sold by Signode Corporation, 3600 West Lake Ave., Glenview, Ill., U.S.A., under the designation "MLN-2A." A number of the major mechanisms comprising the existing machine are described in the U.S. Pat. No. 3,548,740.

In this description, only such portions of the mechanisms disclosed in U.S. Pat. No. 3,548,740 as are relevant to the present apparatus have been illustrated, those portions being described only in sufficient detail as to afford an understanding of the relation to the novel apparatus disclosed herein. However, the entire disclosure of the U.S. Pat. No. 3,548,740, insofar as it is consistent with the present disclosure, is hereby incorporated in, and made a part of, the present disclosure by reference thereto. Such modifications as are necessary to adapt the novel apparatus of this invention to the machine disclosed in the U.S. Pat. No. 3,548,740 are described in detail hereinafter.

Figure 3:
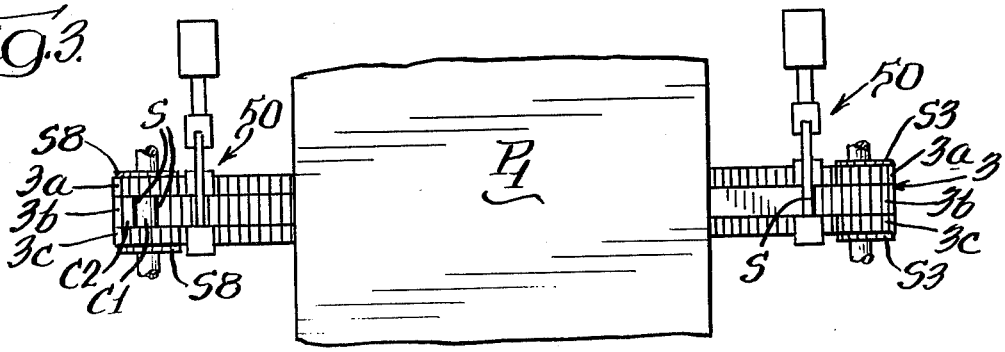
FIG. 3 is a view taken generally along the plane 3—3 in FIG. 1.

The machine includes a conventional strap carrier comprising a pair of spaced apart rollers C1 and C2 which define a pass-through region for the strap S and which rollers are mounted to a conventional multiple strand type chain 3 which generally encompasses a package receiving station occupied by package P1. As best illustrated in FIG. 3, the chain 3 comprises a center strand **3*b* between two outer strands 3*a* and 3*c*. The carrier rollers C1 and C2 are mounted in the center strand 3*b***.

The chain 3 is mounted around the package receiving station on a plurality of conventional pairs of spaced-apart sprockets, which sprockets include at least upper corner sprocket pairs S1 and S2 and lower corner sprocket pairs S3 and S8. Additional sprockets are typically provided, especially adjacent sprocket pairs S3 and S8, but are not shown for purposes of simplicity.

The two outer chain strands **3*a* and 3*c* engage the sprocket teeth of the sprocket pairs S1, S2, S3, and S8. The center strand 3*b* is not engaged by any sprocket and rides free between the two outer strands. The strap S passing through the carrier rollers C1 and C2 thus has a portion which is guided over the outside of the chain center strand 3*b* and a leading portion which passes inside of the center strand 3*b* so as to be free to be wrapped tight about the package while the portion of the strap outside of the chain center strand 3*b*** is continually maintained spaced away from the package.

The sprocket pairs S1, S2, S3, and S8 are typically mounted to a suitable frame (not illustrated) that is provided around the package receiving station. One or more of the sprockets are driven intermittently in one direction or the other by suitable conventional means (not illustrated) to move the chain, and hence the strap carrier rollers C1 and C2 about the package receiving station.

A description of the arrangement of single sprockets for a two-strand chain is illustrated and described in the aforerentioned U.S. Pat. No. 3,548,740 and reference is directed thereto. In the three-strand chain system illustrated herein, the arrangement of the sprockets about the periphery of the package receiving station can be identical to that illustrated in the U.S. Pat. No. 3,548,740 except, of course, that spaced-apart pairs of sprockets would be provided at each sprocket location to engage the outer chain strands **3*a* and 3*c***.

An object to be strapped, such as package $P_1$, is supported in the object or package receiving station on a suitable support structure 19 which includes a conventional anvil 1 arranged to receive the free end of the strap S in underlying relation. The structure 19 also includes a sealer 9 positioned beneath the anvil 1 for movement in working position after an overlapping strap layer is formed beneath the strap free end upon completion of the strap draping and tensioning movement of the carrier rollers.

The support structure 19 includes, among other things, (1) additional grippers (not illustrated) for gripping the free end of the strap for holding strap tension, (2) suitable sealing mechanisms (not illustrated), and (3) strap severing mechanisms (not illustrated). The package support structure 19 and the various mechanisms included therein, though not illustrated in detail in the present disclosure, may be of suitable conventional designs. Examples of suitable designs are those disclosed and illustrated in the aforementioned U.S. Pat. No. 3,548,740. Any suitable designs may be used with the apparatus and the specific designs per se form no part of the present invention.

FIG. 1 illustrates the apparatus in an initial position ready to commence an operation cycle to strap the package $P_1$ located in the package receiving station with the strap S. The strap free end, having been severed from a loop of strap around a previously bound package, is gripped by conventional anvil means 1 at the package support structure 19 beneath the package P1.

The strap S extends outwardly (to the right as viewed in FIG. 1) around a lower corner catch block 50 which maintains the strap spaced away from the bottom of the package $P_1$ in the package receiving station. The catch block 50 may be of any suitable conventional design. A number of designs are currently in commercial use for the lower corner catch blocks 50. Some catch blocks have no moving parts and are said to be "passive." Other catch blocks have moving parts and are said to be "active."

Figure 13:
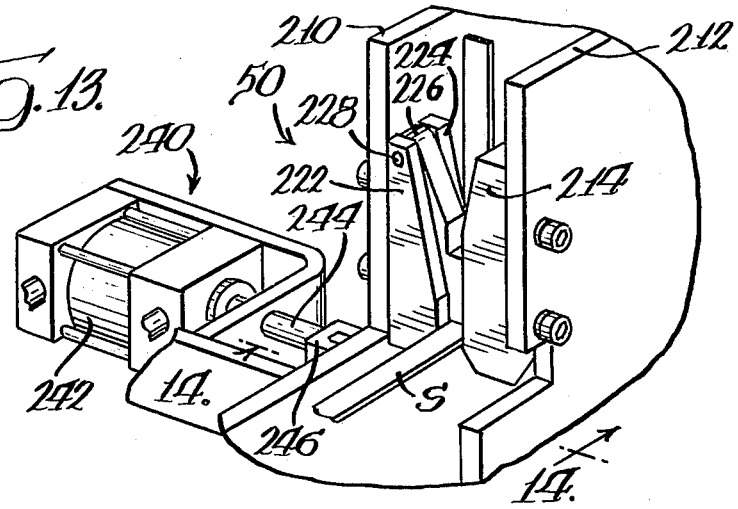
FIG. 13 is a perspective view of a lower active catch block mechanism which may be used with the present invention in place of the passive catch block of FIGS. 9–12.
Figure 14:
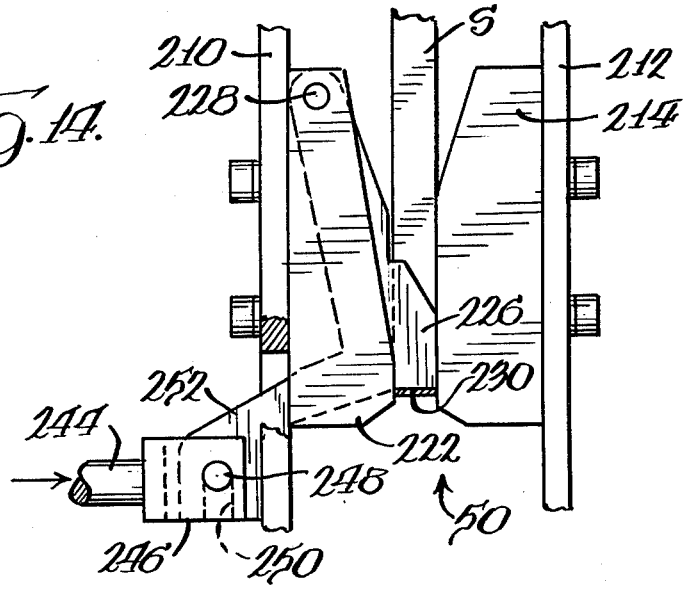
FIG. 14 is a view taken generally along the plane 14—14 and FIG. 13.
Figure 15:
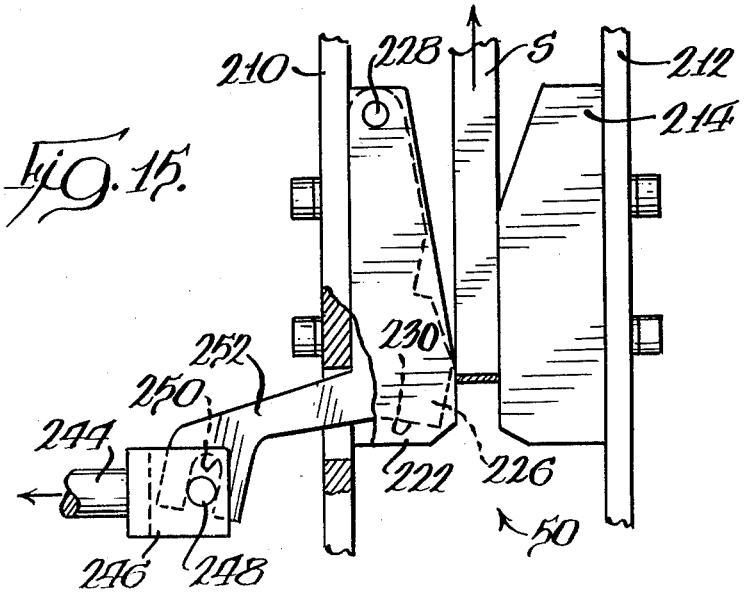
FIG. 15 is a view similar to FIG. 14 but showing the lower active catch block mechanism open to release the strap.

One design of a conventional active catch block 50 is illustrated in FIGS. 13–15 for the right-hand catch block of FIG. 1. The active catch block mechanism is supported by a pair of opposed frame members 210 and 212. A strap guide block 214 is mounted to the frame member 212 and is adapted to guide one edge of the strap S.

A pair of stationary mounting members 222 and 224 are mounted in parallel, spaced-apart relationship to the other frame member 210 across from guide block 214. Mounted between the stationary members 222 and 224 is a movable catch member 226 which is pivotably mounted about a shaft or pin 228 extending between the stationery members 222 and 224. The bottom end of the catch member 226 has a strap engaging surface 230 as best illustrated in solid line in FIG. 14 and in dash line in FIG. 15

The catch member 226 is adapted to move between an extended position illustrated in FIGS. 13 and 14 and a retracted position illustrated in FIG. 15. Initially, the catch member 226 is in the extended position illustrated in FIG. 14.

When the strap S is pulled around the package and towards the catch block 50 (to the position illustrated in FIG. 1), the strap S engages the surface 230 of the catch member 226. When the catch member 226 is moved to the retracted position illustrated in FIG. 15, the strap S, prevented from moving laterally with the member 226 by the stationary members 222 and 224, slips off of the surface 230 and is then free to be pulled in a tight loop around the package.

The catch member 226 is moved between the extended position illustrated in FIGS. 13 and 14 and the retracted position illustrated in FIG. 15 by a suitable mechanism, such as a conventional pneumatic cylinder actuator 240. The actuator 240 includes a cylinder 242 which has a rod 244 extending from the cylinder and carrying a connection assembly 246 at the distal end as best illustrated in FIG. 15.

The connection member 246 comprises a generally U-shaped member which carries a pin 248 between its opposed leg portions. The pin 248 is received in a slot or channel 250 defined in an extending arm 252 of the engaging member 226. The channel 250 is suitably elongated within the arm 252 to permit relative movement between the connecting pin 248 and the arm 252 during the usual extension and retraction operation of the pneumatic cylinder 242.

The cylinder actuator 240 is controlled by suitable conventional means (not illustrated) to effect the extension and retraction of the strap engaging member 226 during certain periods of the strapping cycle described in detail hereinafter. The mechanisms for controlling the actuator 240, and the entire catch block 50, are conventional and the specific designs per se form no part of the present invention.

A conventional passive lower corner catch block may be used, if desired, in place of the active catch block 50. The passive catch block is illustrated in FIGS. 9–12 for the right-hand block in FIG. 1 and is designated generally in those figures by reference numeral 50'. The passive catch block 50' has a slanted, strap slide surface 109 and a bottom surface 110.

Figure 9:
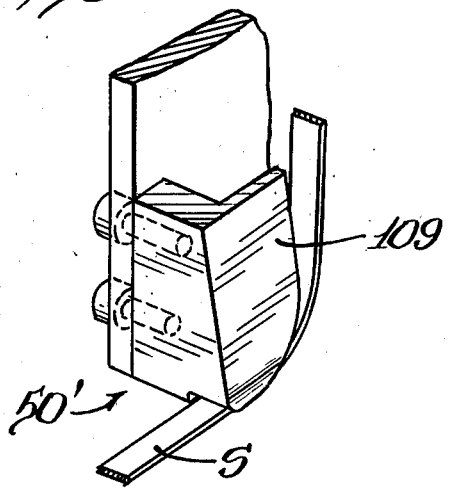
FIG. 9 is a perspective view of a lower passive catch block which may be used with the present invention.
Figure 10:
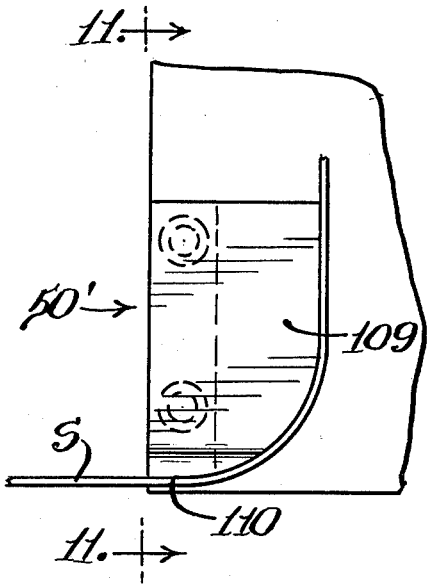
FIG. 10 is a side view of the passive catch block of FIG. 9.
Figure 11:
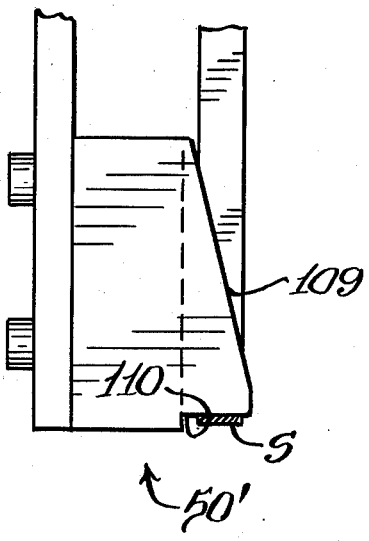
FIG. 11 is a view taken generally along the plane 11—11 of FIG. 10.

As illustrated in FIG. 11, the strap is narrower than the passive catch block engaging surface 110. During the initial draping of the strap S in a generally untensioned (or only lightly tensioned) condition, the strap is maintained by the catch block as shown in FIGS. 9–11. When the strap S is moved around the bottom portion of the receiving station by means of the chain driven carrier rollers C1 and C2, the strap S engages the strap engaging surface 110 of the passive catch block 50' and is held outwardly of the strap receiving station.

Continuing the description of the initial strap position as illustrated in FIG. 1, it is seen that strap S extends upwardly from the lower right-hand corner catch block (active block 50 or passive block 50', as the case may be). The strap S is still spaced outwardly of the package receiving station and extends to a clamp bar assembly 60 which is mounted to the machine frame (not illustrated) in a conventional manner to accommodate movement of the clamp bar assembly 60 upwardly and downwardly relative to the frame and package $P_1$. The clamp bar assembly 60 is a modification of a conventional clamp bar used in the above-referenced Signode MLN-2A strapping machine.

Figure 4:
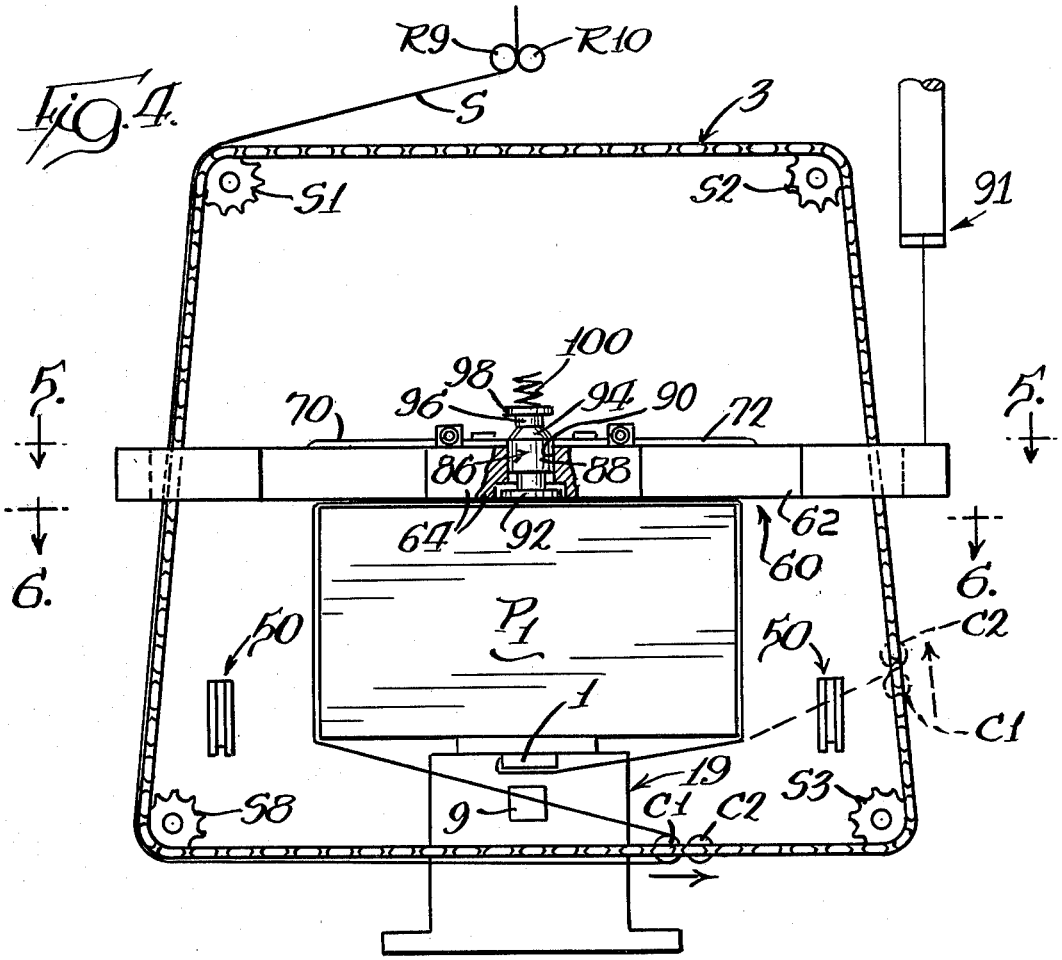
FIG. 4 is a related diagrammatic view similar to FIG. 1 and showing the strap carrier having moved counterclockwise around the receiving station with the strap released by the guide members and drawn around the package $P_1$ and showing the carrier in broken lines at the final tension position.

The clamp bar 60 has suitable drive mechanisms and controls (not illustrated) for moving the mechanism 60 between the fully retracted or elevated position illustrated in FIG. 1 to the lowered position against package $P_1$ as illustrated in FIG. 4. Such drive mechanisms and controls are conventional and form no part of the present invention.

The clamp bar assembly 60 includes a generally horizontally disposed clamp bar or frame 62 and an outwardly extending mounting plate 64. Frame 62 defines an elongate, strap pass-through aperture 66 through which the strap S passes. Specifically, when the machine is in the initial position illustrated in FIG. 1, the strap S passes upwardly from the lower right-hand corner catch block 50 and through the clamp bar frame aperture 66 below the drive chain 3 extending between sprocket pairs S1 and S2.

Pivotably mounted to the plate 64 are a pair of movable guide members 70 and 72. Guide member 70 is pivotably mounted to the plate 64 about shaft 74 and guide member 72 is pivotably mounted to the plate 64 about shaft 76. As best illustrated in FIG. 2, guide member 70 is biased (clockwise as viewed in FIG. 2) by a spring 78 to a position under the path of the strap S while guide member 72 is biased to a position (counterclockwise as viewed in FIG. 2) by a spring 80 also under the path of the strap S.

Figure 2:
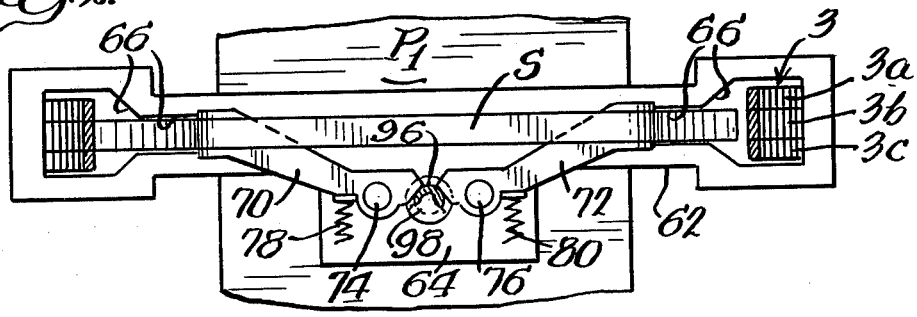
FIG. 2 is a view taken generally along the plane 2—2 in FIG. 1.

As best illustrated in FIG. 2, the strap S extends over the top of the biased guide members 70 and 72 and then passes downwardly through the clamp bar frame aperture 66 to the chain carrier rollers C1 and C2. At the carrier rollers C1 and C2, the strap S is trained around carrier roller C1 and passes back upwardly through the clamp bar assembly aperture 66 on the outside of the chain around sprocket pair S1. From there the strap passes through a pair of centering rollers R9 and R10.

The strap S is guided at the top of the machine by the pair of spaced-apart centering rollers R9 and R10 which allow for feed of the strap in either wrapping direction around the package $P_1$ in the package receiving station. The rollers R9 and R10 are fixed to a suitable support or frame (not illustrated).

The strap S enters the space between the rollers R9 and R10 from a supply of strap, such as a reel of strapping, and preferably, from a strap dispensing and storing section, system or mechanism (not illustrated). Preferably, such a strap dispensing and storing mechanism has facilities whereby, during initial application of the loop, relatively light tension is applied which will not dislodge the loosely positioned package $P_1$ and whereby, after the loop is completed, a high degree of tension becomes effective to draw the loop tight around the package $P_1$ immediately prior to the loop sealing operation. An example of one such strap dispensing and storing mechanism is illustrated and described in the U.S. Pat. No. 4,153,499 and is designated in FIG. 1 of that patent generally by reference characters DS.

Though the strap S is shown entering between the pair of spaced-apart centering rollers R9 and R10 directly from above the rollers, it is to be realized that the strap S may be wrapped partially around each roller R9 and R10 in an S-shaped configuration to provide a greater friction force serving to hold the strap in proper position on the rollers. In such an alternate embodiment, and with reference to FIG. 1, the strap S would enter the machine from above, but adjacent the right side of roller R10. The strap S would then pass around the bottom half of roller R10, up between rollers R10 and R9, around the top half of roller R9, and then over the chain 3 at sprocket pair S1.

As best illustrated in FIG. 1, the clamp bar assembly mounting plate 64 has a package contacting member 86. The member 86 has a generally cylindrical main body portion 88 slidably received in a generally cylindrical bore 90 in the mounting plate 64. The member 86 has a package contacting flange 92 at the bottom end. At the top end, the member 86 has a frustoconical camming surface 94, a generally cylindrical portion 96, and a top end flange 98.

The top end flange 98 is spring biased by spring 100 in a downward direction to bias the package contacting member 86 to the downwardly projecting position illustrated in FIG. 1. To this end, spring 100 is mounted to a suitable extension or portion (not illustrated) of the clamp bar assembly 60 so that it continuously exerts the downward bias against the package contacting member 86. In the position illustrated in FIG. 1, the package contacting member 86 is restrained from further downward movement by the engagement of the package contacting member top flange 98 with the ends of the guide members 70 and 72.

With the above-described construction, the clamp bar assembly 60 is thus seen to provide a guide means by which a trailing portion of a strap S is guided at spaced portions along a path around the receiving station from the interior of that path. This retains the strap S in a configuration spaced outwardly of the package receiving station for a major portion of the locus of a closed path around the station.

In operation, the machine functions as follows. First, the package $P_1$ is moved into position in the object or package receiving station on top of the package support structure 19. The package $P_1$ may be properly positioned either after the machine mechanisms have assumed the initial positions illustrated in FIG. 1 or during the movement of the machine mechanisms to those positions illustrated in FIG. 1.

In any case, a strapping cycle begins with the machine mechanisms at rest in the positions illustrated in FIG. 1 and with the package $P_1$ properly positioned at the object or package receiving station on the support 19 as illustrated in FIGS. 1–3. When the carrier rollers C1 and C2 eventually move from the initial position and pass around the sprocket pair S8, a portion of the strap will remain inwardly of the chain to complete the loop around the package while the trailing portion is maintained by chain 3 outwardly of the package $P_1$.

Before the carrier rollers C1 and C2 begin to move in the counterclockwise direction around the package $P_1$, the clamp bar assembly 60 is moved to the downward position against the package $P_1$. Suitable means is provided for moving the clamp bar assembly 60 against the package and such means may include a conventional pneumatic cylinder actuator 91 (schematically illustrated only in FIGS. 1, 4, 7, and 8). The clamp bar 62 holds the package $P_1$ tight against the support structure 19 to prevent the package $P_1$ from being moved by the strap S when the strap S is later tensioned in a tight loop about the package. Before the clamp bar 62 contacts the package $P_1$, the contacting flange 92 of the package contact member 86 engages the package and this prevents further downward movement of the contact member 86. The bar 62 continues to move downwardly against the package $P_1$ and thus moves downwardly relative to contact member 86.

The actuation of the clamp assembly 60 may be controlled by any suitable mechanism or system. For example, a timer system may be used to initiate the downward movement of the clamp assembly 60.

As the bar 62 is moved downwardly relative to the member 86, the frustoconical portion 94 of the member 86 is exposed above bore 90. The ends of the guide members 70 and 72 thus engage the portion 94 which functions as a cam to pivot the guide members 70 and 72 out from beneath the strap S.

Figure 5:
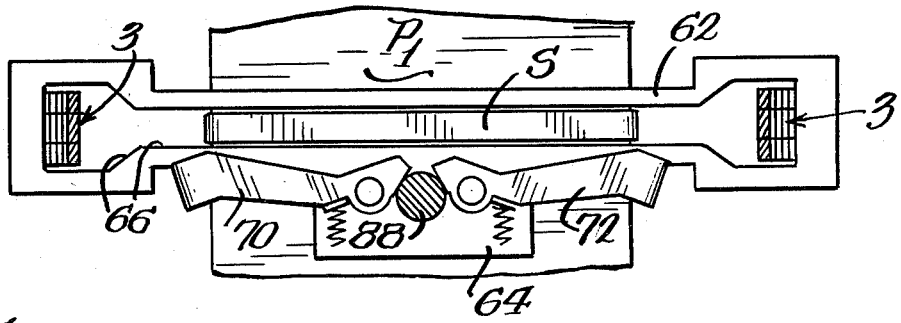
FIG. 5 is a view taken generally along the plane 5—5 in FIG. 4.
Figure 6:
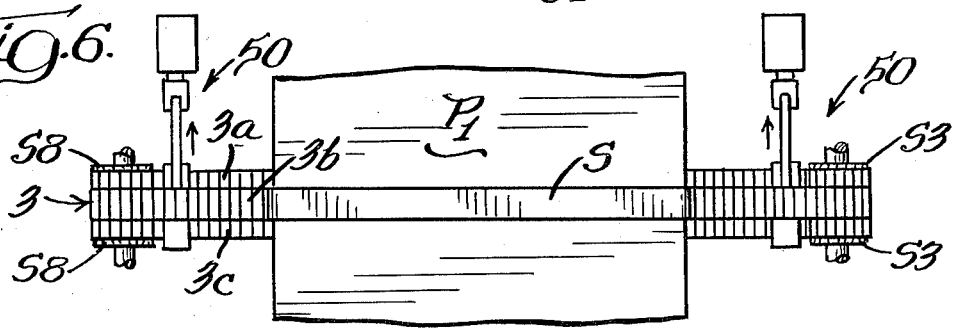
FIG. 6 is a view taken generally along the plane 6—6 in FIG. 4.

When the bar 62 of assembly 60 is in downwardmost position against the package $P_1$ as illustrated in FIG. 4, the inner ends of the guide members 70 and 72 are engaged by the increased diameter cylindrical portion 88 of the member 86 to maintain the guide members 70 and 72 in the outwardly pivoted position (see also FIG. 5). When the guide members 70 and 72 are thus pivoted outwardly, the strap S is no longer restrained from the interior of the strap path and is free to be pulled against and around the package $P_1$ when the carrier rollers C1 and C2 are next moved by chain 3 as illustrated in FIG. 4 (in a counterclockwise direction about the package receiving station).

With reference to FIG. 4, it is to be noted that both the right-hand catch block 50 and the left-hand catch block 50 are not effective to hold the strap S away from the package$_1$ as the strap is fed in the counterclockwise direction to complete the loop about the package $P_1$.

Specifically, if the blocks are of the above-described passive type (FIGS. 9–12), the strap S will become disengaged from the right-hand block and will not be engaged by the left-hand block. This is because the lowering of the clamp bar assembly 60 causes the strap S to move out of engagement with the right-hand passive catch block and to slide past the left-hand passive catch block as will next be explained.

Figure 12:
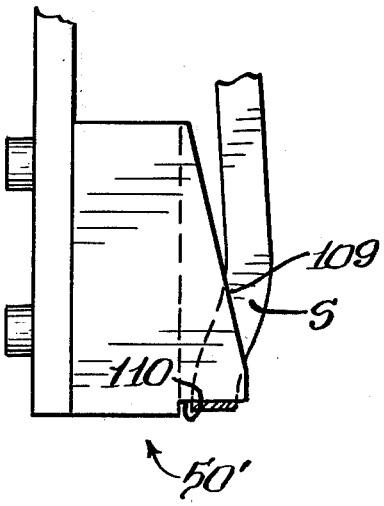
FIG. 12 is a view similar to FIG. 11, but showing the strap slipping off of the lower passive catch block.

As illustrated for the right-hand passive catch block in FIG. 12, the strap S, as it is lowered with the downward movement of the clamp bar assembly 60, forms a more acute angle around the catch block and slides downwardly over the slanted surface 109 of the catch block. Eventually, the strap, under tension from the strap dispensing and storing mechanism (not illustrated), slides completely off of the right-hand catch block and is then free to be pulled tight against and around the package $P_1$ by the carrier rollers C1 and C2.

With reference to FIG. 4, the lower left-hand passive catch block does not restrain the strap S outwardly of the package. Specifically, the strap S will slip down the left-hand catch block slanted surface 109 and past the catch block after the clamp bar assembly 60 has been lowered and as the carrier rollers C1 and C2 are moved to pull the strap tight around the package $P_1$ in the counterclockwise direction.

If the lower catch blocks 50 are of the above-described active type (FIGS. 13–15), both the left-hand and right-hand lower catch blocks are preferably actuated to open after the clamping bar assembly 60 has been moved to the downwardmost position to clamp the package $P_1$ against the support 19. Thus, the strap S will be free to be drawn tight around the package $P_1$ when the rollers C1 and C2 are moved in the counterclockwise direction. Preferably, a suitable control sequence is initiated by a timer system actuated by the downward movement of the clamp bar assembly 60. The timer system simultaneously opens the lower active catch blocks 50 and starts the counterclockwise movement of chain 3 after the package $P_1$ has been securely clamped. Since, in the preferred embodiment, the guide members 70 and 72 are actuated to retract simultaneously with the clamping of the package $P_1$ by the downward movement of the clamp bar assembly 60, the upper guide members 70 and 72 are thus retracted and the active lower corner catch blocks 50 are thus opened as the strap S begins to be pulled around the bottom of the package $P_1$. While the loop of strap S is tensioned about the package $P_1$, the clamp assembly 60 is preferably held against the package $P_1$ with a predetermined downward force.

FIG. 4 illustrates, in broken lines, the movement of the carrier rollers C1 and C2 to the extreme counterclockwise position at the point where maximum tension in the strap loop is applied. At this point, the overlapping strap ends are joined by a suitable mechanism, such as by the friction fusion mechanism or sealer described and illustrated in great detail in the above-referenced U.S. Pat. No. 3,548,740.

Following the sealing of the overlapping strap ends, the trailing portion of the strap is severed by a suitable mechanism (not illustrated). One such suitable strap severing mechanism is disclosed in the above-referenced U.S. Pat. No. 3,548,740 with reference therein to the cutter blade 40.

Figure 7:
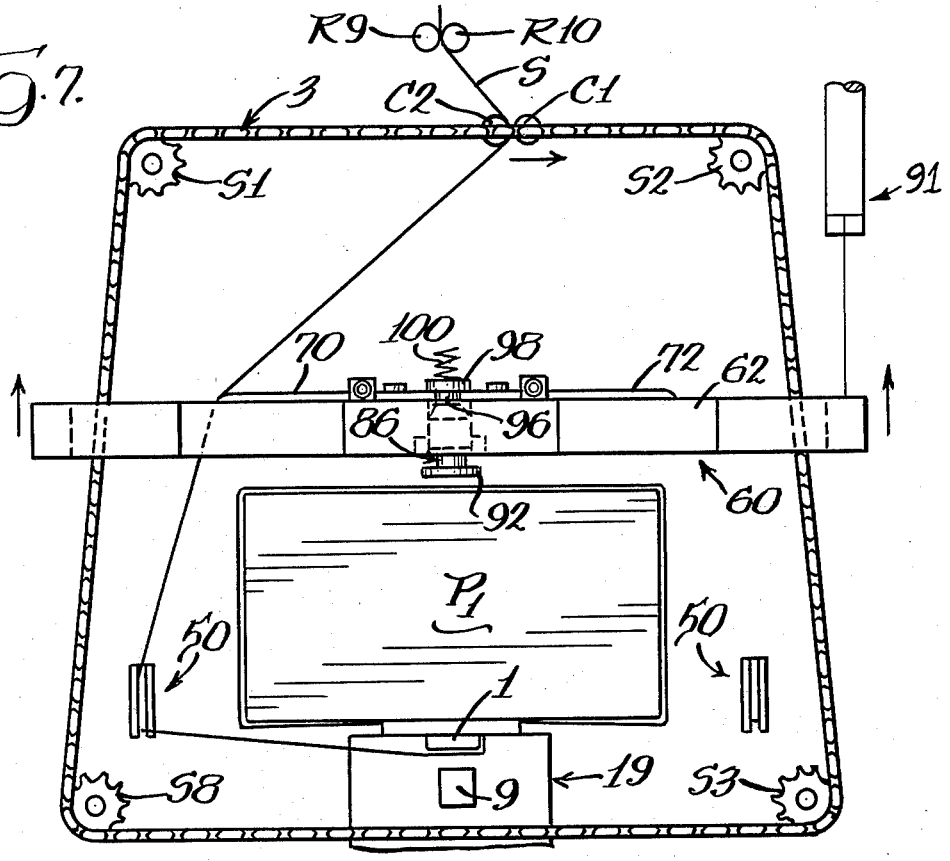
FIG. 7 is a related fragmentary view similar to FIG. 4 but showing the loop of strap having been tensioned and sealed around the package $P_1$, showing the sealed loop severed from the rest of the strap, and showing the trailing portion of the strap being carried back in the opposite direction to pre-drape the package receiving station.

FIG. 7 illustrates the package $P_1$ after having been bound with the loop of strap S which has been sealed about the package $P_1$ and then severed from the trailing portion of the strap. While the package $P_1$ is still in the package receiving station on the package support structure 19, the chain 3 is driven in the opposite direction (clockwise as viewed in FIG. 7) to begin pre-draping the package receiving station with the strap. To this end, rotation of the sprocket pair or pairs driving the chain 3 is reversed while the lower catch blocks 50, if they are of the above-described active type (FIGS. 13–15), are actuated to close so that the lower left-hand block will hold the strap outwardly away from the package receiving station. If the lower catch blocks are of the above-described passive type (FIGS. 9–12), the bottom surface 110 of left-hand lower block will be engaged by the strap S as it is pulled around the block.

As the carrier rollers C1 and C2 are moved by the chain to pre-drape the package receiving station with the strap S, the clamp assembly 60 is moved upwardly (in response to a suitable control system). As the clamp bar assembly 60 moves out of contact with the bound package $P_1$ as illustrated in FIG. 7, the package contacting member 86 is biased downwardly by the spring 100. This permits the guide members 70 and 72 to be biased inwardly (by their springs 78 and 80, respectively, as illustrated in FIG. 2) below the strap path. Thus, as illustrated in FIG. 7, the strap begins to engage the guide members and is held outwardly from, or above, the package receiving station.

As the strap S is continued to be pre-draped about the package receiving station, the previously bound package $P_1$ may be moved out of the package receiving station, either by hand or automatically. Also, as the package receiving station is continuing to be pre-draped by the strap S, the next or second package $P_2$ may be moved by hand or automatically into proper position in the package receiving station on the package support structure 19 as best illustrated in FIG. 8.

Figure 8:
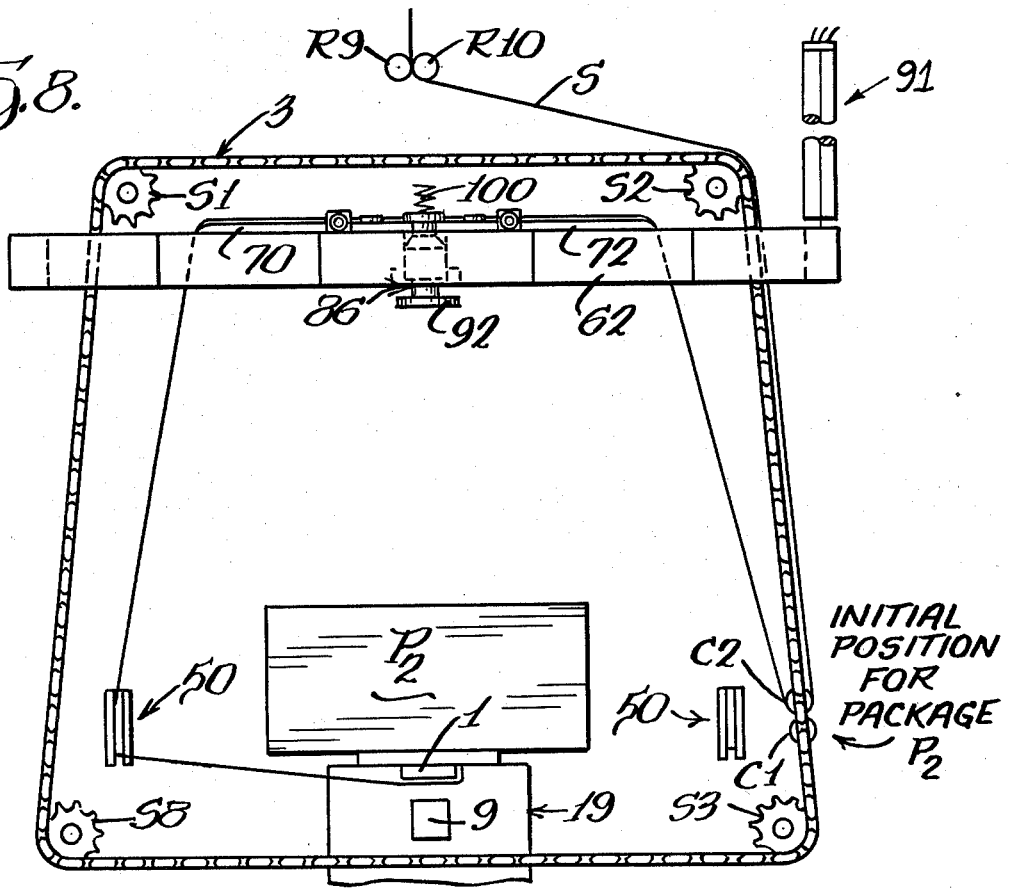
FIG. 8 is a related fragmentary view similar to FIG. 7 but showing a new package $P_2$ moved into position in the receiving station which has been pre-draped by the strap with the strap carrier being located at the next cycle's initial position for forming a new strap loop in the clockwise direction; ;p

During the pre-draping step, the carrier rollers C1 and C2 are moved to the initial pre-draping position illustrated in FIG. 8 whereupon the movement of the chain is terminated. Preferably, the chain moves the carrier rollers C1 and C2 to the pre-draped initial position before the next package $P_2$ has reached the proper position in the object receiving station. Thus, the machine is ready to immediately strap the next package $P_2$ from the pre-draped configuration—providing a savings in time and greatly speeding up the overall rate when a plurality of packages are to be strapped seriatim.

Preferably, the pre-draping of the package receiving station by the carrier rollers C1 and C2 occurs within a fraction of a second after severing the strap from the previously bound and sealed package $P_1$. The apparatus is then in the initial position for strapping the next package $P_2$ before that next package $P_2$ is even located in the package receiving station.

To strap the next package $P_2$, the strapping cycle described above is repeated, but in the opposite direction starting from the new initial position illustrated in FIG. 8. The next cycle would be effected in the opposite direction (clockwise as viewed in FIG. 8) to tighten the loop about the package $P_2$. Upon completion of the strapping of the package $P_2$, the strap carrier rollers C1 and C2 would be in the first, pre-draped, initial position identical to that illustrated in FIG. 1.

It will be readily observed from the foregoing detailed description of the invention and in the illustrative embodiment thereof that numerous variations and modifications may be effected without departing from the true spirit and scope of the novel concept and principles of this invention.

What is claimed is:

1. In a chuteless method for forming a loop of flexible binding about objects positioned seriatim in an object receiving station, said method including restraining an end of said binding adjacent said receiving station and then pulling a trailing portion of the binding in a closed path around an object; said method characterized by the improvement comprising:

(a) while a previously bound first object is in said receiving station, initially pulling said trailing portion of the binding through a major portion of the locus of said closed path around the receiving station and guiding spaced portions of said binding from the interior of said path around said receiving station to retain the binding in a configuration spaced outwardly of said receiving station;

(b) after commencing step (a), removing the bound first object from said receiving station;

(c) positioning a second object in said receiving station; and (d) after terminating step (c), terminating said interior guiding of the binding around said receiving station to permit said binding to contact said second object while further pulling said trailing portion of the binding completely around said closed path and to then form a tensioned loop about the second object.

2. The method in accordance with claim 1 in which step (d) also includes temporarily clamping said second object in said object receiving station while further pulling the binding completely around said closed path.

3. The method in accordance with claim 1 in which step (a) includes guiding the binding from the interior of said path by positioning guide members between said object receiving station and the binding and by pulling the binding against said guide members.

4. The method in accordance with claim 1 in which the step (a) process of initially pulling said trailing portion of the binding includes pulling the binding with a carrier in a slip feeding engagement with a portion of the binding trailing said restrained end.

5. In a chuteless method for forming a loop of flexible binding about an object positioned in an object receiving station, said method including the steps of restraining an end of said binding adjacent said receiving station, pulling a trailing portion of the binding in a closed path around said object, pulling the binding to form a tensioned loop about said object, sealing the loop, and then severing the sealed loop from the rest of the binding; said method characterized by the improvement comprising the following steps:

before removing the bound object from said receiving station, at least commencing the additional steps of initially pulling a portion of the binding through a major portion of the locus of said closed path around said receiving station and guiding spaced portions of said binding from the interior of said path around said receiving station to retain the binding in a configuration spaced outwardly of said receiving station.

6. The method in accordance with claim 5 wherein the additional step of pulling the binding through a major portion of the locus of said closed path is terminated before removing the bound object from the object receiving station.

7. The method in accordance with claim 5 further including removing the bound object from said receiving station and wherein the additional step of pulling the binding through a major portion of the locus of said closed path is terminated after removing said bound object from the receiving station and before another object is positioned in the object receiving station.

8. A chuteless apparatus for forming a loop of flexible binding about an object positioned in an object receiving station, said apparatus having means for restraining an end of said binding adjacent said receiving station, means for pulling a trailing portion of the binding in a closed path around said object in one direction, means for sealing the loop, and means for then severing the sealed loop from the rest of the binding, said apparatus characterized by the improvement comprising:

means for continuing said pulling of a trailing portion of said binding after binding a first object while restraining the severed end of the trailing portion of said binding adjacent said receiving station, said means for continuing said pulling of the trailing portion of the binding including (1) means for pulling the binding through a major portion of the locus of said closed path in the other direction around said receiving station and (2) means for initiating said pulling of the binding in the other direction prior to removal of the bound first object from said receiving station; and guiding means for temporarily guiding spaced portions of said trailing portion of said binding from the interior of said path around said receiving station to temporarily retain the binding in a configuration spaced outwardly of said receiving station for a major portion of the locus of said closed path, said guiding means including means for initiating the retention of said outwardly spaced binding after said first object is bound and for retaining the binding in the outwardly spaced configuration at least until the replacement of the bound first object in said receiving station with a second unbound object.

9. The apparatus in accordance with claim 8 in which said guiding means includes movable guide members, means for moving said guide members between the object receiving station and the binding, and means for retracting said guide members from between the object receiving station and the binding.

10. The apparatus in accordance with claim 8 in which said apparatus further includes a clamp bar assembly adapted to contact each said object in said receiving station and means for moving said clamp bar assembly between an elevated position spaced above said object receiving station and a lowered position contacting said object to hold said object in said object receiving station, in which said temporary guiding means includes guide members pivotably mounted on said clamp bar assembly and means biasing the guide members between the object receiving station and the binding, said guiding means further including an object contacting member carried by said clamp bar assembly and adapted to move relative to said clamp bar assembly between a first position in contact with said object in said object receiving station and a second position when not in contact with said object, said guiding means further including means for normally biasing said object contacting member to said second position, said guiding means further including cam means on said object contacting member and movable therewith for engaging said guide members and retracting said guide members from between the receiving station and the binding when said clamp assembly is moved to said lowered position against said object with said object contacting member assuming said first position relative to said lowered clamp bar assembly.

11. In a chuteless method for forming a loop of flexible binding about objects positioned seriatim in an object receiving station, said method including restraining an end of said binding adjacent said receiving station and then pulling a trailing portion of the binding in a closed path around an object; said method characterized by the improvement comprising:

(a) while a previously bound first object is in said receiving station, initially pulling said trailing portion of the binding through a major portion of the locus of said closed path around the receiving station and guiding spaced portions of said binding from the interior of said path around said receiving station to retain the binding in a configuration spaced outwardly of said receiving station;

(b) after commencing step (a), removing the bound first object from said receiving station;

(c) positioning a second object in said receiving station;

(d) clamping said second object in said receiving station; and (e) in response to step (d), terminating said interior guiding of the binding around said receiving station to permit said binding to contact said second object while further pulling said trailing portion of the binding completely around said closed path and to then form a tensioned loop about the clamped second object.

12. A chuteless apparatus for forming a loop of flexible binding about an object positioned in an object receiving station, said apparatus having means for restraining an end of said binding adjacent said receiving station, means for pulling a trailing portion of the binding in a closed path around said object, means for sealing the loop, and means for then severing the sealed loop from the rest of the binding, said apparatus characterized by the improvement comprising:

means for initially continuing said pulling of a trailing portion of said binding after binding a first object while restraining the severed end of the trailing portion of said binding adjacent said receiving station, said means for continuing said pulling of the binding including means for pulling the binding through a major portion of the locus of said closed path around said receiving station;

a clamp bar assembly adapted to contact a second object positioned in place of said first object in said receiving station;

means for moving said clamp bar assembly between an elevated position spaced above said object receiving station and a lowered position contacting said second object to hold said second object in said object receiving station;

guide members pivotably mounted on said clamp bar assembly and means biasing said guide members between the object receiving station and the binding for temporarily guiding spaced portions of the binding from the interior of said path around said receiving station to temporarily retain the binding in a configuration spaced outwardly of said receiving station for a major portion of the locus of said closed path;

an object contacting member carried by said clamp bar assembly and adapted to move relative to said clamp bar assembly between a first position in contact with said second object in said receiving station and a second position when not in contacat with said second object;

means for normally biasing said object contacting member to said second position;

cam means on said object contacting member and movable therewith for engaging said guide members and retracting said guide members from between the receiving station and the binding when said clamp bar assembly is moved to said lowered position against said second object with said object contacting member assuming said first position relative to said lowered clamp bar assembly to permit said binding to contact said second object; and means for initiating operation of said binding pulling means to pull said trailing portion of the binding completely around said closed path to form a tensioned loop about the second object.

* * * * *